US005415385A

United States Patent [19]

Newsome et al.

[11] Patent Number: 5,415,385

[45] Date of Patent: May 16, 1995

[54] APPARATUS FOR COLLATING AND FEEDING DOCUMENTS

[75] Inventors: John R. Newsome, Shumway; Roger Evans; Kenneth Polarek, both of Effingham, all of Ill.

[73] Assignee: Southern Illinois Machinery Co., Incorporated, Shumway, Ill.

[21] Appl. No.: 185,591

[22] Filed: Jan. 21, 1994

[51] Int. Cl.[6] ..... B65H 39/05

[52] U.S. Cl. ..... 270/58; 270/57; 271/3.1; 271/9; 271/186; 271/202; 271/225; 271/270

[58] Field of Search ..... 270/54, 55, 57, 58; 271/9, 3.1, 6, 216, 225, 202, 270, 184, 186

[56] References Cited

U.S. PATENT DOCUMENTS

| | | | |
|---|---|---|---|
| 3,522,943 | 8/1970 | Swanson | 271/6 |
| 4,078,785 | 3/1978 | Davis | 270/58 |
| 4,330,116 | 5/1982 | Newsome . | |
| 4,747,817 | 5/1988 | Newsome . | |
| 5,088,711 | 2/1992 | Newsome | 270/54 |
| 5,222,720 | 6/1993 | Newsome | 270/58 X |
| 5,326,088 | 7/1994 | Newsome | 271/3.1 |

*Primary Examiner*—Edward K. Look
*Assistant Examiner*—John Ryznic
*Attorney, Agent, or Firm*—Leydig, Voit & Mayer, Ltd.

[57] ABSTRACT

Groups of differently printed advertising inserts are collated into stacks of at least two inserts each, and the stacks are advanced along a main predetermined path for feeding to a host machine having continuously moving pockets which contain newspaper jackets and which receive the collated stacks of inserts in order to marry the inserts and the jackets. Initially, at least two relatively tall stacked bundles of inserts are located above and are spaced laterally from the main path. Inserts are stripped from the tall bundles, are advanced laterally toward the main path and are stacked in two relatively short queues located above and spaced along the path. A first vacuum belt strips inserts from the upstream queue and advances such inserts in an upstream direction as a running shingle, which then reverses directions and proceeds downstream. As an incident thereto, successive leading inserts are stripped from the shingle and are advanced in spaced relation along the main path toward the host machine. Inserts in the downstream queue are stripped therefrom by a second vacuum belt and are advanced upstream as a second running shingle, which also reverses directions and proceeds downstream. As the second shingle proceeds downstream, successive leading inserts are stripped therefrom and are placed on top of the spaced inserts previously stripped from the first shingle and being advanced along the main path. Spaced stacks of collated inserts are thus formed. The stacks are elevated from the main path, simultaneously inverted and turned at right angles to the main path, advanced laterally relative to the main path and then fed vertically downwardly into the pockets of the host machine.

11 Claims, 7 Drawing Sheets

FIG. 4
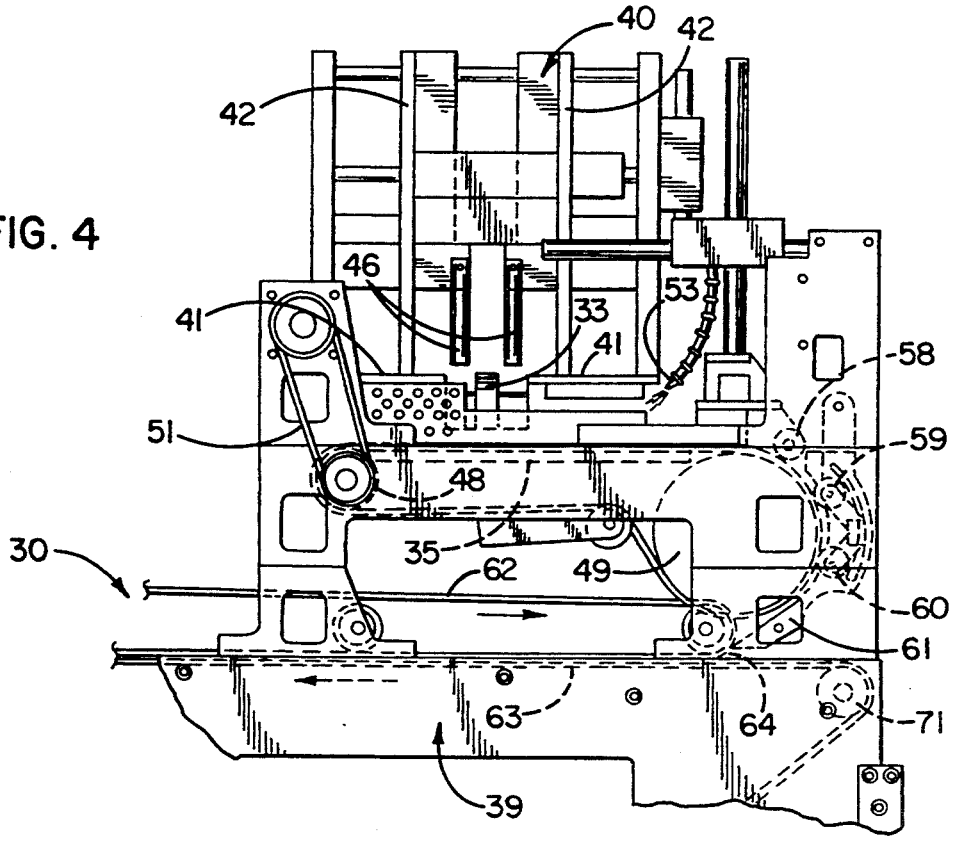
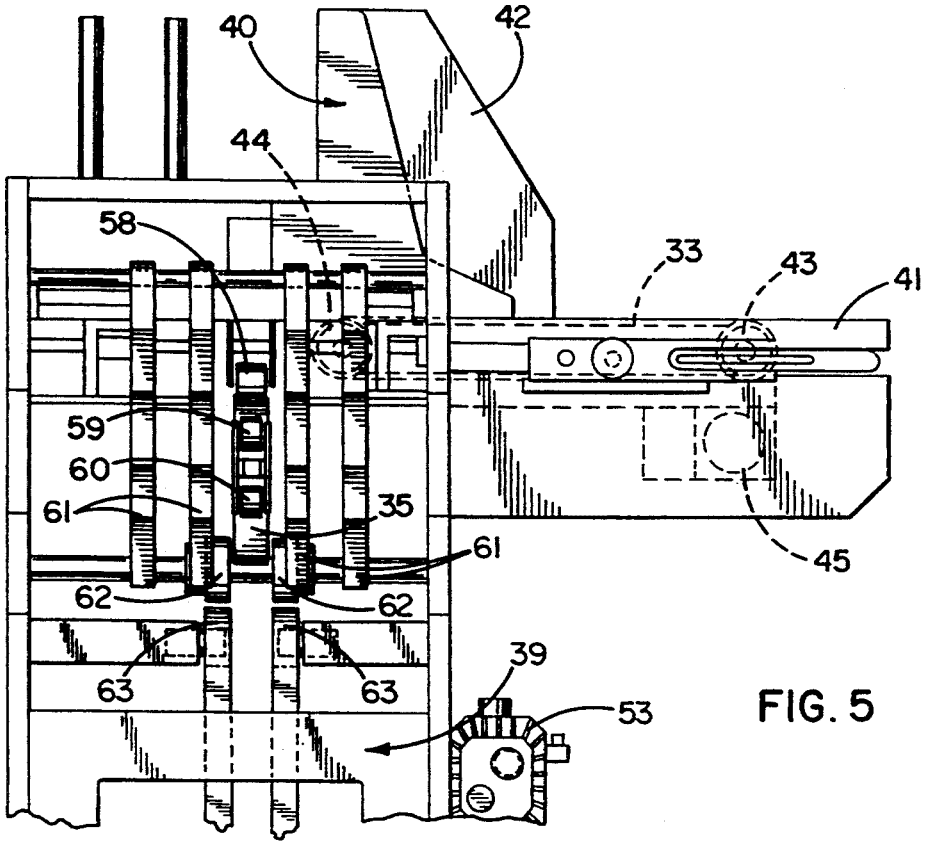
FIG. 5

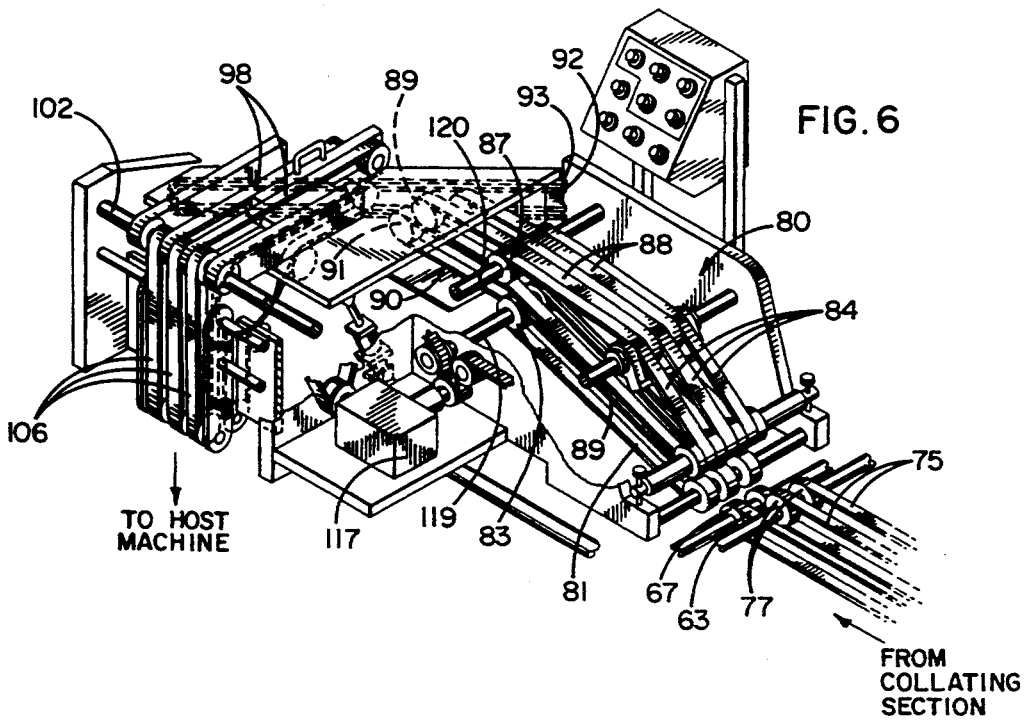
FIG. 6
FIG. 7
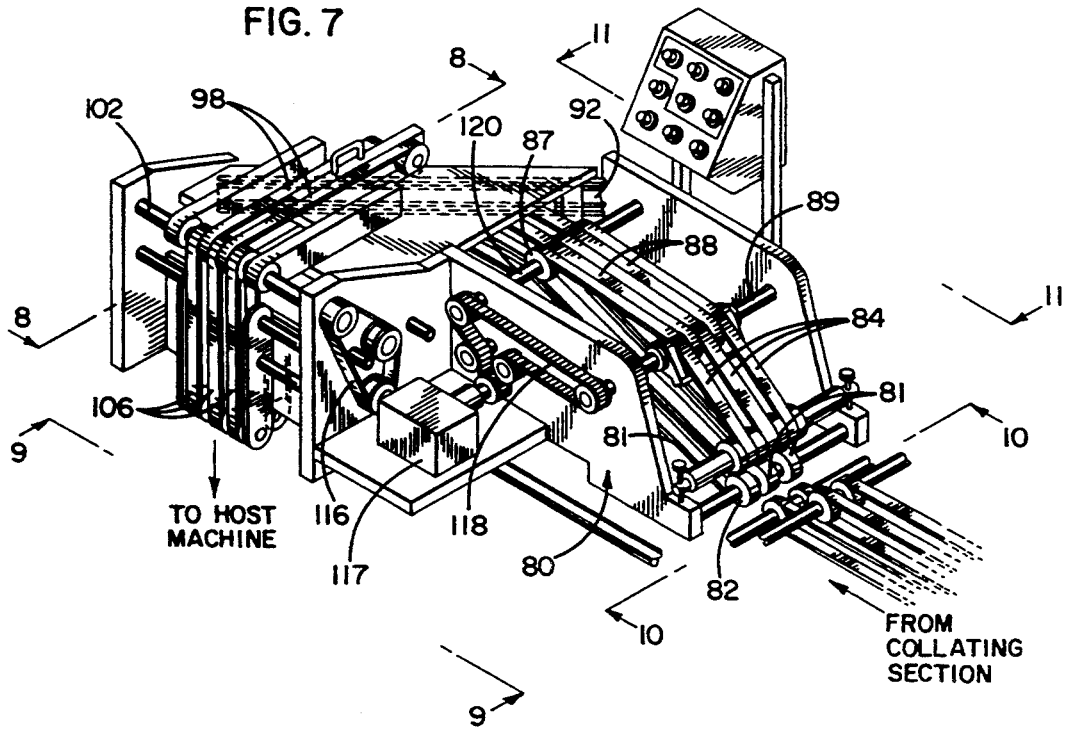

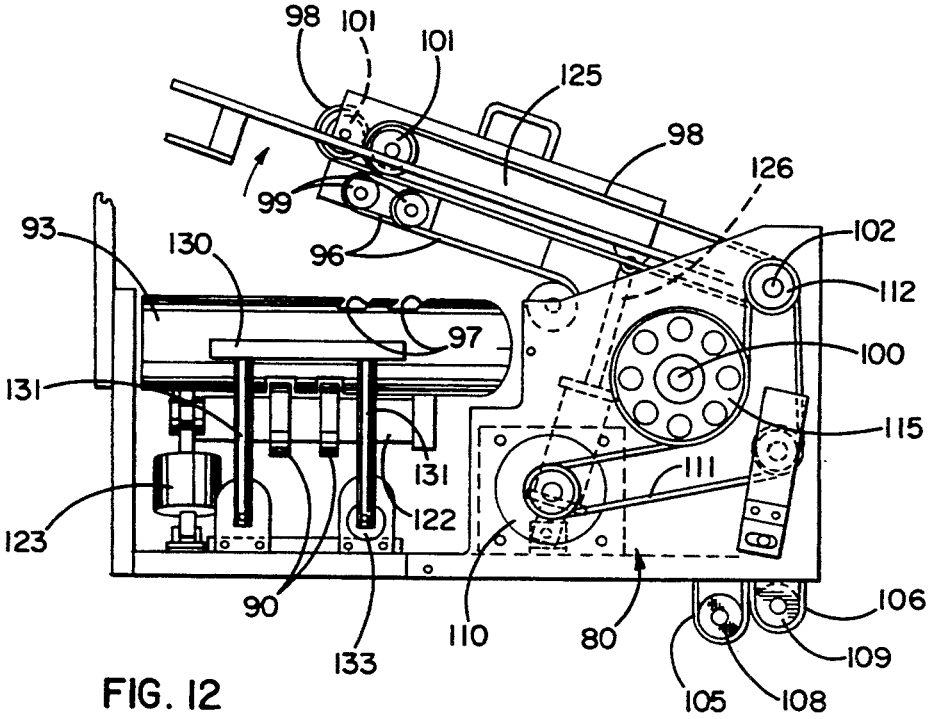
FIG. 12
FIG. 13
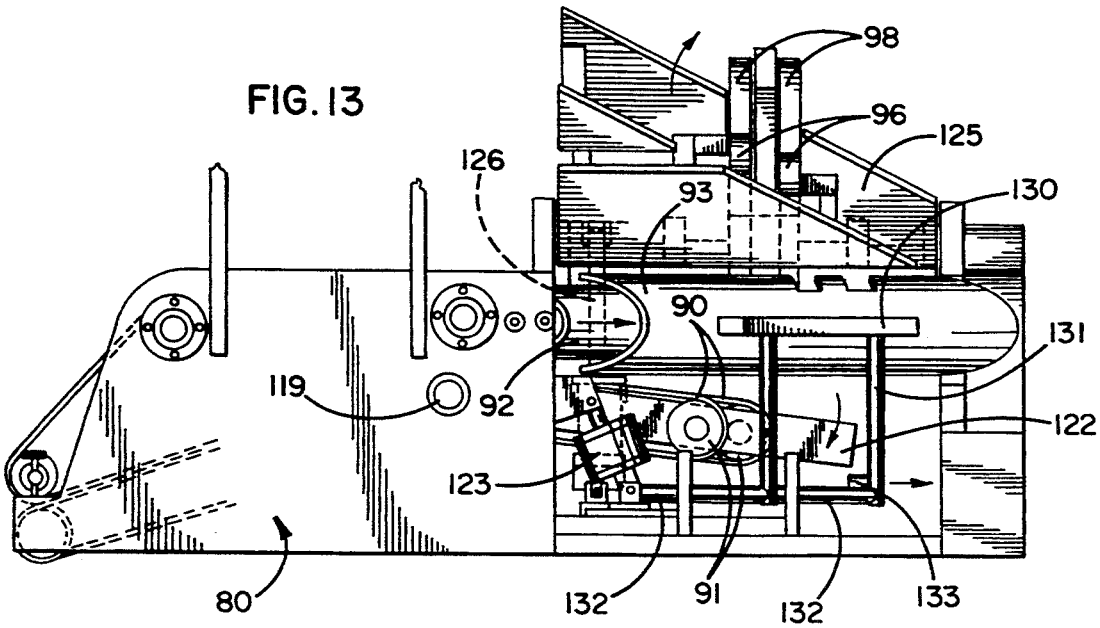

APPARATUS FOR COLLATING AND FEEDING DOCUMENTS

BACKGROUND OF THE INVENTION

This invention relates generally to apparatus for collating different documents into a plurality of stacks and for advancing the collated stacks along a predetermined path toward a using station.

By way of example, the documents which are collated by the apparatus of the invention may be advertisements which are printed separately from a newspaper and which subsequently are inserted into or grouped with the newspaper for delivery to the consumer. Such advertisements conventionally are called "inserts" while the main body of the newspaper conventionally is called a "jacket".

Typically, various advertising inserts are printed at various locations and are collected at the newspaper publisher's plant for collating and for grouping with the jackets printed by the publisher. The jackets are usually carried in spaced pockets of a continuously moving conveyor which advances successive pockets at high speeds through a receiving station where inserts are added to each jacket. The conveyor serves as the so-called host machine for the collating apparatus.

Advertising inserts typically are made of thin, lightweight and relatively porous paper which is difficult to handle and feed. Because of the porosity of the paper, the use of conventional vacuum cups for picking up and transferring inserts in the collating operation is disadvantageous. The vacuum produced by such cups acts through the porous paper and tends to cause multiple inserts to stick together thereby making it difficult for the cups to pick up and transfer one insert at a time.

SUMMARY OF THE INVENTION

The general aim of the present invention is to provide new and improved insert collating and feeding apparatus which is especially capable of handling lightweight and porous inserts in a very high speed, extremely flexible and substantially trouble-free operation.

In large, the foregoing is achieved through the provision of apparatus in which at least two relatively tall stacked bundles of inserts are located above and are spaced laterally from a main predetermined path along which collated stacks of inserts are advanced toward the host machine. Inserts are stripped from the tall bundles, are advanced laterally toward the main path and are stacked in two relatively short queues located above and spaced along the path. A first vacuum belt strips inserts from the upstream queue and advances such inserts in an upstream direction as a running shingle, which then reverses directions and proceeds downstream. As an incident thereto, successive leading inserts are stripped from the shingle and are advanced in spaced relation along the main path toward the host machine. Inserts in the downstream queue are stripped therefrom by a second vacuum belt and are advanced upstream as a second running shingle, which also reverses directions and proceeds downstream. As the second shingle proceeds downstream, successive leading inserts are stripped therefrom and are placed on top of the spaced inserts previously stripped from the first shingle and being advanced along the main path. In this way, spaced stacks of collated inserts are advanced along the main path and toward the host machine for insertion into the pockets containing the jackets.

A further object of the invention is to provide apparatus for receiving the stacks of inserts from the collator, for elevating the stacks and turning the stacks at right angles to the main path, and for then advancing the stacks horizontally toward the host machine and downwardly into the pockets thereof.

The invention also resides in the provision of insert turning and advancing mechanisms which may be opened up in a relatively easy manner to enable the clearing of jams.

These and other objects and advantages of the invention will become more apparent from the following detailed description when taken in conjunction with the accompanying drawings.

BRIEF DESCRIPTION OF THE DRAWINGS

FIGS. 4 and 5 are enlarged elevational views as seen substantially along the lines 4—4 and 5—5, respectively, of FIG. 3.

FIGS. 6 and 7 are perspective views of apparatus for turning and inverting the inserts and for feeding the inserts to the host machine after the inserts have been collated.

FIGS. 12 and 13 are views similar to FIGS. 8 and 11, respectively, but show certain components of the turning apparatus in positions enabling the clearing of jammed documents.

Figure 1:
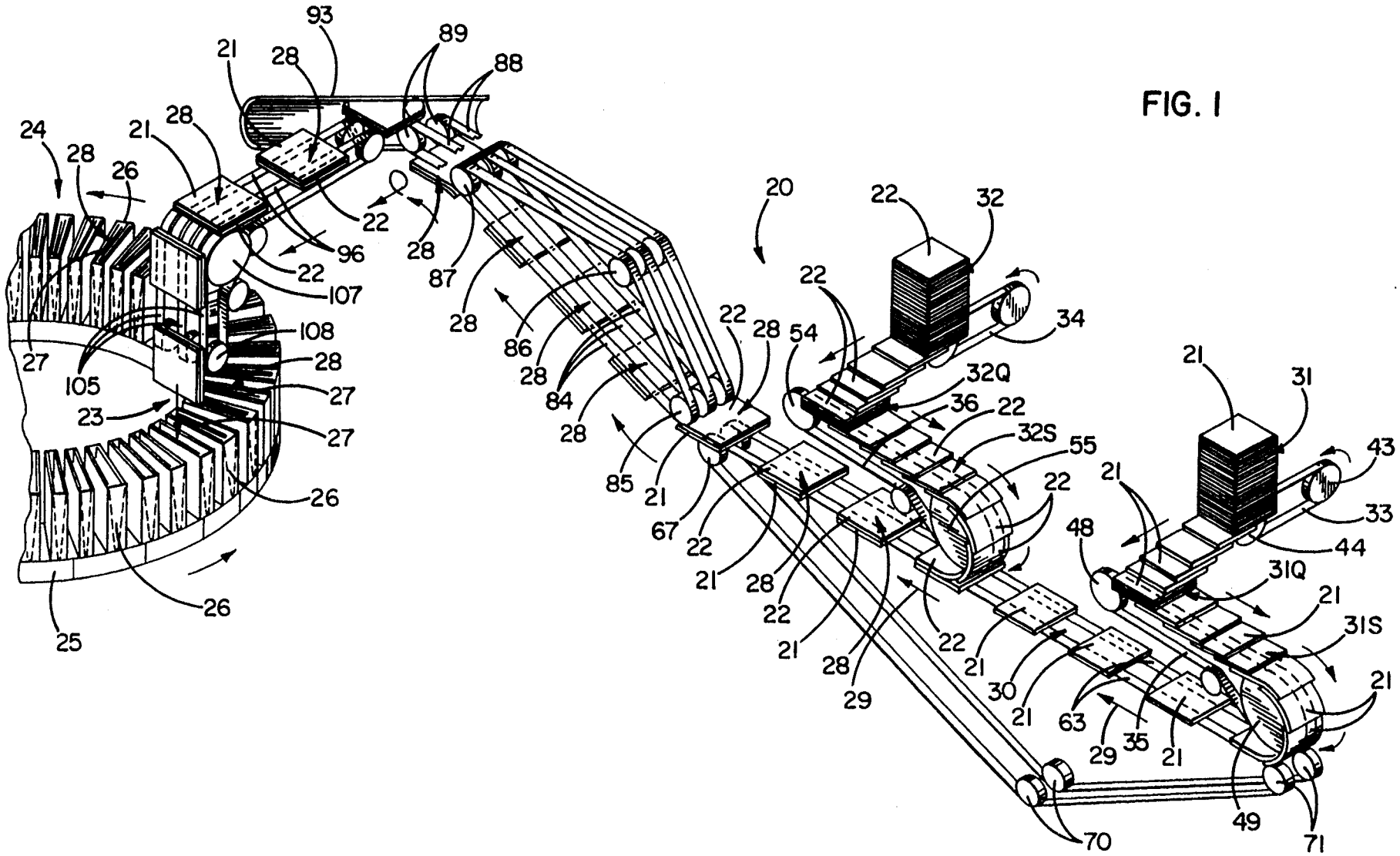
FIG. 1 is a schematic perspective view of new and improved document collating and feeding apparatus incorporating the unique features of the present invention.

While the invention is susceptible of various modifications and alternative constructions, a certain illustrated embodiment hereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE PREFERRED EMBODIMENT

For purposes of illustration, the invention has been shown in the drawings as incorporated in apparatus 20 for collating different documents 21 and 22 and for feeding the documents as collated stacks to a using station 23. In this particular instance, the using station is located at a so-called host machine 24 which includes a rotary turntable 25 with a series of angularly spaced pockets 26. Newly printed newspapers 27—commonly called jackets—are carried in the pockets 26 and are advanced to the using or transfer station 23 where each pocket receives a stack 28 of documents 21 and 22. Herein, the documents 21 and 22 are preprinted advertising inserts which are brought to the newspaper publisher's plant to be grouped with the jackets 27 by the apparatus 20 of the present invention.

The turntable 25 is operated with continuous motion and at high speed, advancing as many as 24,000 jackets 27 per hour past the transfer station 23. Instead of including a rotary turntable, the host machine 24 could utilize an endless belt conveyor with pockets for holding the jackets 27 and for receiving the collated stacks 28.

In a general sense, the inserts 21 and 22 are collated as they are advanced in the direction of the arrows 29 along a predetermined and generally horizontal path which has been designated as 30. Initially, the inserts 21 are manually loaded into the apparatus 20 in the form of a relatively tall stacked bundle 31 which is located above and spaced laterally from the path 30. The inserts 22 are manually loaded into the apparatus 20 as a relatively tall bundle 32 which also is located above and spaced laterally of the path 30. The bundle 32 is located downstream along the path from the bundle 31.

Stripping conveyors 33 and 34 underlie the bundles 31 and 32, respectively. Each stripping conveyor is driven in short bursts and, when driven, strips successive bottom inserts 21, 22 from the respective bundle 31, 32 and advances the inserts laterally toward the path 30. The inserts 21 from the bundle 31 are formed into a relatively short stacked queue 31Q located in direct overlying relation with the main path 30. Similarly, the inserts from the bundle 32 are also formed into a relatively short stacked queue 32Q which also directly overlies the path 30 and which is spaced downstream from the queue 31Q.

Vacuum belts 35 and 36 underlie the queues 31Q and 32Q, respectively. The vacuum belt 35 strips successive bottom inserts 21 from the queue 31Q and forms such inserts into a running shingle 31S which is initially advanced in an upstream direction along a generally horizontal path spaced above and extending parallel to the main path 30. As is well known, a shingle is a running group of documents in which the leading end portion of a trailing document overlies the trailing end portion of a leading document and having a setback equal to the distance by which the trailing document overlaps the leading document.

The vacuum belt 36 strips successive bottom inserts 22 from the queue 32Q and advances such inserts in an upstream direction as a running shingle 32S which is spaced downstream from the shingle 31S. The shingle 32S also initially advances along a generally horizontal path spaced above and extending parallel to the path 30.

After the shingle 31S proceeds upstream a predetermined distance from the queue 31Q, it curves downwardly and then starts to advance in a downstream direction. As the shingle exits the curve, successive leading inserts 21 in the shingle are accelerated and are pulled away from the main body of the shingle. By virtue of being accelerated, the inserts proceed downstream in spaced relation along the main path 30. As a result of curving downwardly and reversing directions, the inserts advanced in spaced relation along the path 30 are inverted with respect to the inserts in the bundle 21, the queue 31Q and the initial portion of the shingle 31S.

In a similar manner, the shingle 32S advances upstream a predetermined distance from the queue 32Q and then curves downwardly to begin proceeding in a downstream direction. As the shingle 32S starts to leave the curve, successive leading inserts 22 in the shingle are accelerated and pulled away from the main body of the shingle so as to establish a spaced relation between the inserts. As each insert 22 is stripped from the shingle 32S, it falls on top of an insert 21 previously stripped from the shingle 31S and proceeding downstream. As a result, spaced stacks 28 each containing two inserts 21 and 22 are formed and are advanced downstream and in spaced relation along the main path 30 toward the transfer station 23.

Figure 2:
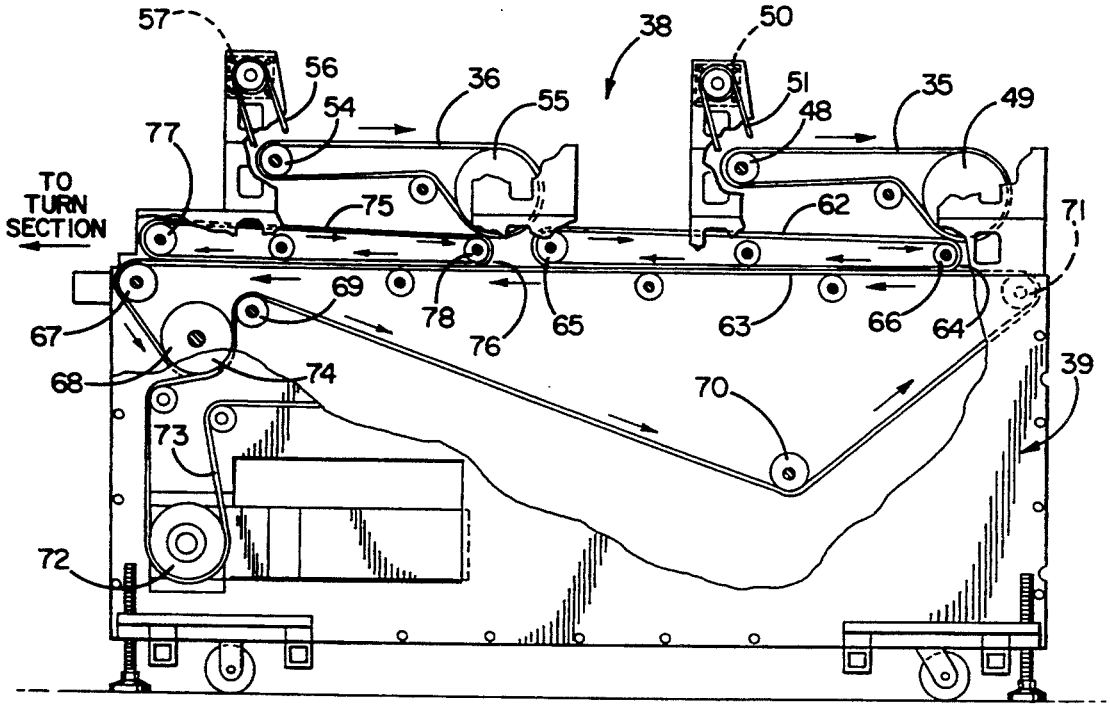
FIG. 2 is a side elevational view of the main section of the collating and feeding apparatus, certain parts being broken away and shown in section.
Figure 3:
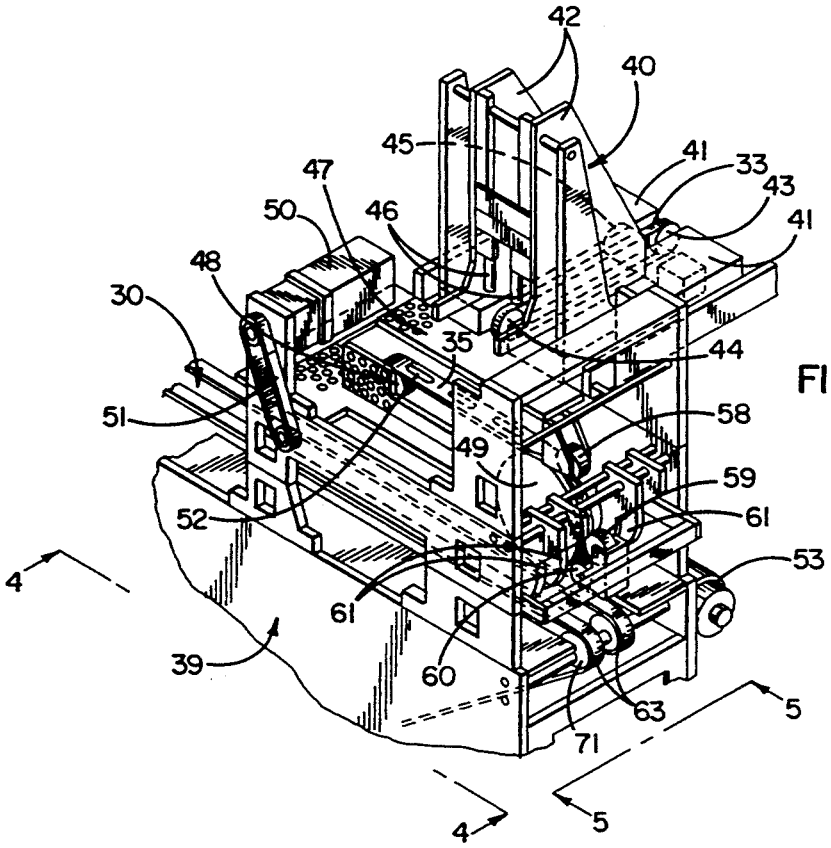
FIG. 3 is an enlarged perspective view of certain components of the apparatus shown in FIG. 2.

Now that the operation of the main section of the collating and feeding apparatus 20 has been described, the structure and mechanisms for carrying out the operation will be explained. The main section of the apparatus includes a module 38 (FIG. 2) having a wheel-supported base which has been designated in its entirety by the reference numeral 39. Supported on and spaced along the base are two hoppers for holding the stacked bundles 21 and 22. The two hoppers are identical and thus only the hopper 40 for the upstream bundle 21 has been shown in detail. It comprises two bottom platform members 41 (FIGS. 3 and 4) for supporting the bundle 31 and two upstanding side plates 42 for confining the inserts 21 in the bundle. The stripper belt 33 is located in the space between the two platforms and is trained around pulleys 43 and 44 (FIG. 5). The pulley 43 is adapted to be driven by an ac. on/off motor 45 and, when driven, advances the upper run of the belt 33 laterally toward the path 30. The upper run of the belt frictionally grips successive lowermost inserts 21 in the bundle 31 and flings such inserts laterally so as to form the queue 31Q. Being tall, the bundle 31 is relatively heavy and thus the inserts 21 tend to stick together. To facilitate stripping of the inserts from the bundle, two air nozzles 46 (FIGS. 3 and 4) are located near the downstream end of the belt 33 and fluff the bundle to aerate and separate the inserts. While it is desirable that only one insert at a time be stripped from the bundle, the operation is not detrimentally affected if multiple inserts are simultaneously stripped.

As the inserts 21 are flung laterally by the belt 33, they collect in the queue 31Q on a plate 47 (FIG. 3) located adjacent the upper side of the upper run of the vacuum belt 35. The vacuum belt 35 is trained around a drive pulley 48 (FIG. 2) and a significantly larger return pulley or sheave 49 which, with respect to the direction of the main path 30, is located upstream of the drive pulley. The drive pulley 48 is adapted to be driven by a servo motor 50 which is operably connected to the pulley by a drive belt 51.

The vacuum belt 35 itself is essentially of conventional construction, and reference is made to Newsome U.S. Pat. No. 5,088,711 for a more detailed disclosure of a vacuum belt for stripping documents from a queue and for forming the documents into a running shingle. Briefly, the vacuum belt is formed with a series of spaced ports 52 (FIG. 3) adapted, over a certain run of the belt, to communicate with a vacuum plenum (not detailed) which is maintained at negative pressure by a vacuum pump 53. Herein, the ports 52 in the belt are spaced 4½" from one another, and the belt is positioned such that successive ports in the upper run of the belt move beneath the queue 31Q. As the ports move beneath the queue, the vacuum created in the plenum acts through the ports and causes the belt to clutch successive lowermost inserts 21 in the queue. As a result of such clutching, successive inserts are stripped from the queue and are formed into the shingle 31S, which has a substantially uniform 'setback due to the spacing of the ports and the speed of the belt. To insure against the simultaneous stripping of multiple inserts from the queue and to help promote the uniform setback, laterally spaced air nozzles 53 (one of which is visible in FIG. 4) are positioned at the leading face of the queue in order to aerate and lubricate the inserts. The height and weight of the queue 31Q are substantially less than the height and weight of the bundle 31 and thus there is less tendency for the inserts to stick together in the queue. Moreover, the tendency of the inserts to stick together in the queue is reduced due to the fact that the inserts become fluffed and separated upon being flung from the bundle to the queue by the stripper belt 33. Accordingly, the vacuum belt 35 reliably pulls only one insert at a time from the queue so that inserts are not doubled up in the shingle 31S.

In order to keep the queue 31Q of comparatively short height, the stripper belt 33 is operated intermittently so as to fling inserts 21 from the bundle 31 to the queue in relatively short bursts. For this purpose, a photoelectric sensor (not visible) detects the height of the queue and energizes the motor 45 for the belt 35 when the queue falls below a predetermined height. After the motor has been energized for a predetermined period of time, a timer times out and de-energizes the motor until the latter again is triggered by the signal from the photoelectric sensor. The use of a photoelectric sensor to control the height of a queue of documents is explained in more detail in the aforementioned Newsome patent.

The vacuum belt 36 is identical to the vacuum belt 35 and is trained around a drive pulley 54 (FIG. 2) and a larger sheave 55. A drive belt 56 is operably connected between the pulley 54 and a servo motor 57.

As the upstream shingle 31S starts to move downwardly around the sheave 49, the inserts 21 are pressed against the vacuum belt 35 and the sheave by a nip roller 58 (FIGS. 3 and 5) which is located at about a one o'clock position relative to the sheave. Two additional nip rollers 59 and 60 are located at approximately two o'clock and four o'clock positions, respectively, and press the inserts 21 against the belt 35 as the shingle 31S proceeds to curve downwardly around the sheave. As the inserts approach the roller 58, the vacuum ports 52 are covered by the sheave 49 and thus vacuum holding of the inserts is discontinued.

Two guide shoes 61 (FIGS. 3–5) are located on each side of the sheave 49 and cause the shingle 31S to exit the turn along a downwardly inclined path extending substantially tangent to the sheave. Each shoe is of two-piece construction and defines a slot through which the inserts 21 pass as they proceed around the turn.

As an incident to exiting the turn around the sheave 49, successive leading inserts 21 in the shingle 31S are accelerated and pulled away from the shingle so that the inserts may advance downstream along the main path 30 in spaced apart relation. For this purpose, two laterally spaced upper nip belts 62 (FIGS. 2 and 5) coact with two laterally spaced lower nip belts 63 to define an entrance throat 64 (FIG. 4) located beneath the sheave 49 adjacent the lower ends of the shoes 61. The upper nip belts 62 are trained around sets of pulleys 65 and 66 (FIG. 2), the downstream pulleys 65 being driven to advance the upper belts in the direction of the arrows in FIG. 2. The lower nip belts 63 are trained around sets of pulleys 67, 68, 69, 70 and 71 and are advanced in the direction of the arrows in FIG. 2 by virtue of driving the pulleys 68. Driving of the pulleys 65 and 68 is effected by a servo motor 72 on the base 39 acting to drive a cogged belt 73 which is operably connected to the pulleys. For purposes of clarity, only a portion of the cogged belt 73 has been shown. The cogged belt acts through a sprocket 74 to rotate the pulleys 68 and acts through another sprocket (not visible) to rotate the pulleys 65.

The nip belts 62 and 63 are driven at a linear speed which is faster than the linear speed of the vacuum belt 35. As a result, when successive leading inserts 21 in the shingle 31S enter the throat 64 and are nipped between the belts 62 and 63, such inserts are accelerated and are pulled away from the trailing portion of the shingle. The inserts thus are Separated from the shingle and are advanced in precisely spaced relation between the belts 62 and 63 along the main path 30 and downstream toward the sheave 55 of the vacuum belt 36.

Nip rollers identical to the nip rollers 58, 59 and 60 and guide shoes identical to the guide shoes 61 are positioned adjacent the sheave 55 of the vacuum belt 36. In addition, a second pair of upper nip belts 75 (FIGS. 2 and 6) overlies the lower nip belts 63 and coacts with the lower nip belts to define an entrance throat 76 (FIG. 2) adjacent the sheave 55. The belts 75 are trained around pulleys 77 and 78 and are advanced at the same speed as the belts 63 by virtue of the cogged belt 73 driving the pulleys 77.

With the foregoing arrangement, the inserts 22 in the shingle 32S advanced by the vacuum belt 36 are handled in the same way as the inserts 21 in the shingle 31S advanced by the vacuum belt 35. That is to say, the shingle 32S proceeds around the sheave 55 and, as an incident thereto, successive leading inserts 22 enter the throat 76 defined by the belts 63 and 75. The inserts 22 are accelerated by the belts 63 and 75 and are pulled away from the shingle 32S so as to establish a spaced relation between the inserts. As each insert 22 starts being stripped away from the shingle 32S, it is placed on top of an insert 21 previously stripped from the shingle 31S and being advanced downstream by the belts 62 and 63. The two inserts thus are formed into a stack 68 which is advanced downstream between the belts 63 and 75 in precisely spaced relation with respect to preceding and following stacks.

The stacks 68 formed by collating the inserts 21 and 22 are advanced upwardly from the main path 30, are inverted and substantially simultaneously are advanced laterally and horizontally at right angles to the path 30, and then are advanced downwardly for insertion into the pockets 26 of the turntable 25 for marriage with the jackets 27 in the pockets. For this purpose, the apparatus 20 includes a so-called turn section located downstream of the collating section. The turn section includes its own main base which has been designated in its entirety by the reference numeral 80 (FIG. 6). A lower set of three upwardly inclined nip belts 81 (FIG. 7) is trained around pulleys 82 located immediately downstream of the pulleys 67 of the nip belts 63, the nip belts 81 also being trained around a second set of pulleys 83 spaced upwardly from and downstream of the pulleys 82. An upper set of three nip belts 84 is trained around pulleys 85, 86 and 87 (FIG. 1). The lower runs of the upper belts 84 extend parallel to and closely overlie the upper runs of the lower belts 81. Accordingly, stacks 28 exiting the belts 63 and 75 are nipped between the belts 81 and 84 and are advanced along a path which is inclined upwardly relative to the path 30.

Two additional upper nip belts 88 (FIGS. 1 and 6) are located between the upper runs of the belts 84 and are trained around upstream pulleys (not visible) on the same shaft 89 (FIG. 6) as the pulleys 86. The nip belts 88 are horizontally disposed and also are trained around upstream pulleys 89. Located below the belts 88 is a pair of lower horizontal nip belts 90 which are trained around downstream pulleys 91 and upstream pulleys (not visible) which are located on the same axis as the pulleys 83 for the belt 81. Stacks 28 emerging from between the upper ends of the belts 81 and 84 are nipped between the belts 88 and 90 and are advanced horizontally for a short distance in the same direction as the path 30 but at a higher elevation.

Figure 11:
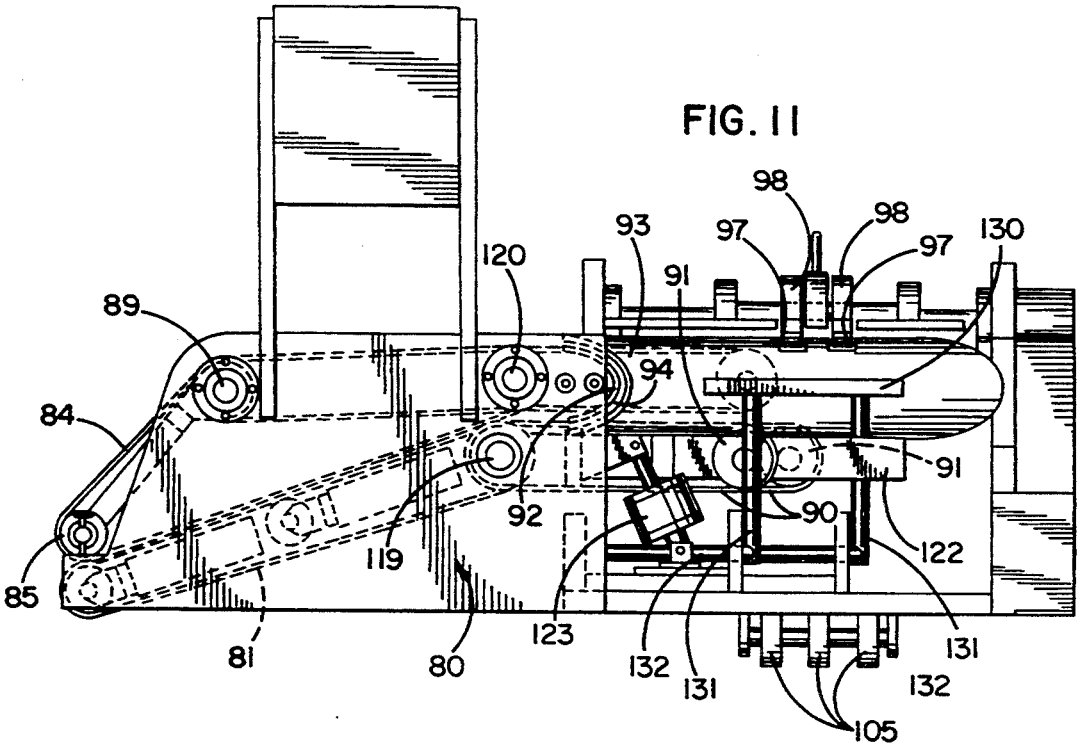

The stacks 28 fed between the belts 88 and 90 are advanced to a turning device which both inverts the stacks and causes the stacks to proceed laterally at right angles to their previous course. Herein, the turning device comprises a semi-cylindrical tube 92 (FIGS. 11 and 13) extending approximately at 45 degrees relative to the belts 88 and 90 and further comprises a semi-cylindrical guide scoop 93 which normally is disposed alongside the tube in spaced relation thereto so that a relatively narrow gap 94 (e.g., $\frac{1}{4}$") exists between the outer diameter of the tube and the inner diameter of the scoop. The exit end portions of the upper belts 88 extend into the tube and the gap while the exit end portions of the lower belts 90 are exposed to the gap by virtue of running within notches 95 (FIG. 8) formed in the lower side of the scoop.

Located above the scoop 93 is an outfeed assembly comprising a pair of lower laterally extending and horizontal nip belts 96 (FIGS. 1 and 8) whose entrance end portions extend into the tube 92 and into the gap 94 between the tube and the scoop 93. Overlying the lower belts 96 and extending into the gap by way of notches 97 (FIGS. 11 and 12) in the scoop are two upper laterally extending and horizontal nip belts 98. The entrance or upstream ends of the lower belts 96 are trained around pulleys 99 (FIGS. 8 and 12) while the exit ends of such belts are trained around pulleys (not visible) carried on a shaft 100. The upper belts 98 are trained around entrance end pulleys 101 (FIGS. 8 and 12) and exit end pulleys (not visible) on a shaft 102.

Stacks 28 advanced into the gap 94 between the tube 92 and the scoop 93 by the belts 88 and 90 are guided 180 degrees around the tube by the scoop and are picked up by the belts 96 and 98 before leaving the belts 88 and 90. By virtue of the 45 degree orientation of the tube and the scoop and by virtue of the positions of the belts 88, 90 and 96, 98, the stacks are turned so as to advance at right angles to their original course and, at the same time, are turned upside down. The inverted stacks are pulled out of the gap 94 between the tube and the scoop by the belts 96 and 98 and are advanced laterally toward the host machine 24 along a horizontal path extending at right angles to and located at a higher elevation than the main path 30.

Figure 8:
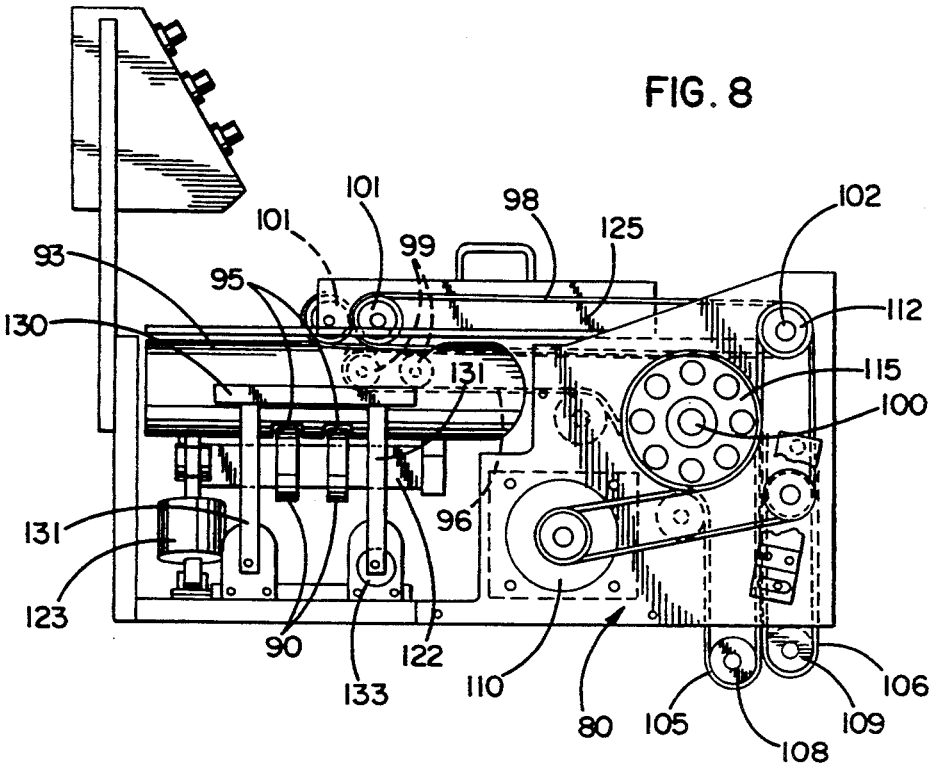
FIGS. 8, 9, 10 and 11 are enlarged side elevational views as seen substantially along the lines 8—8, 9—9, 10—10 and 11—11, respectively, of FIG. 7.
Figure 9:
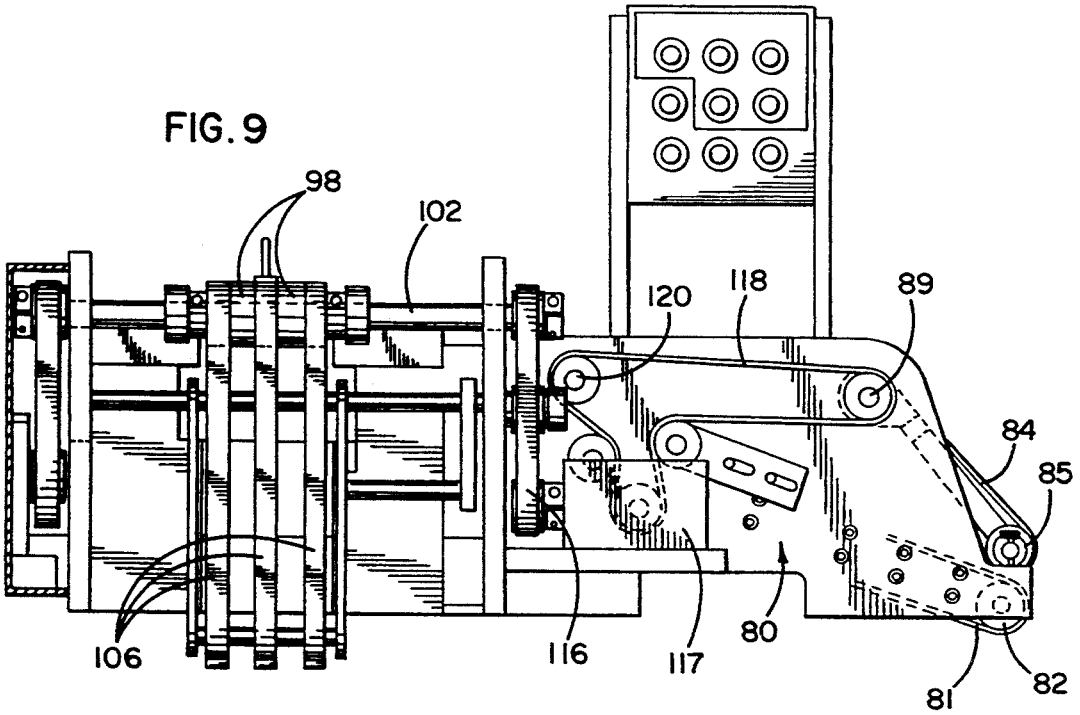

Means are provided for advancing the stacks 28 vertically downwardly from the exit ends of the belts 96 and 98 to the pockets 26 of the turntable 25. Herein, these means comprise a set of three vertically extending rear belts 105 (FIGS. 6, 8 and 9) and a set of three similarly extending front belts 106 (FIGS. 8 and 12) having rear runs located parallel with and closely adjacent the front runs of the-rear belts. The rear belts 105 are trained around upper and lower pulleys 107 and 108 (FIG. 1) while the front belts 106 are trained around upper pulleys (not visible) on the shaft 102 and lower pulleys 109 (FIG. 8). The belts 105 and 106 are positioned such that they define an entrance throat positioned adjacent the exit throat between the belts 96 and 98. Accordingly, stacks 28 advanced horizontally by the belts 96 and 98 are nipped between the belts 105 and 106 and are fed vertically downwardly into the transfer station 23 for insertion into the pockets 26.

Driving of the various belts of the turn section is effected by a servo motor 110 (FIG. 8) mounted on the base 80 and connected by a drive belt 111 to a sprocket 112 (not shown) on the same shaft 102 as the pulleys for the belts 98 and 106. The drive belt 111 thus serves to rotate the pulleys and advance the belts 98 and 106. The drive belt also is connected to a sprocket 115 on the shaft 100 which supports the pulleys for the lower belts 96 and the rear belts 105. Rotation of the shaft 100 thus effects driving of the belts 96 and 105.

Figure 10:
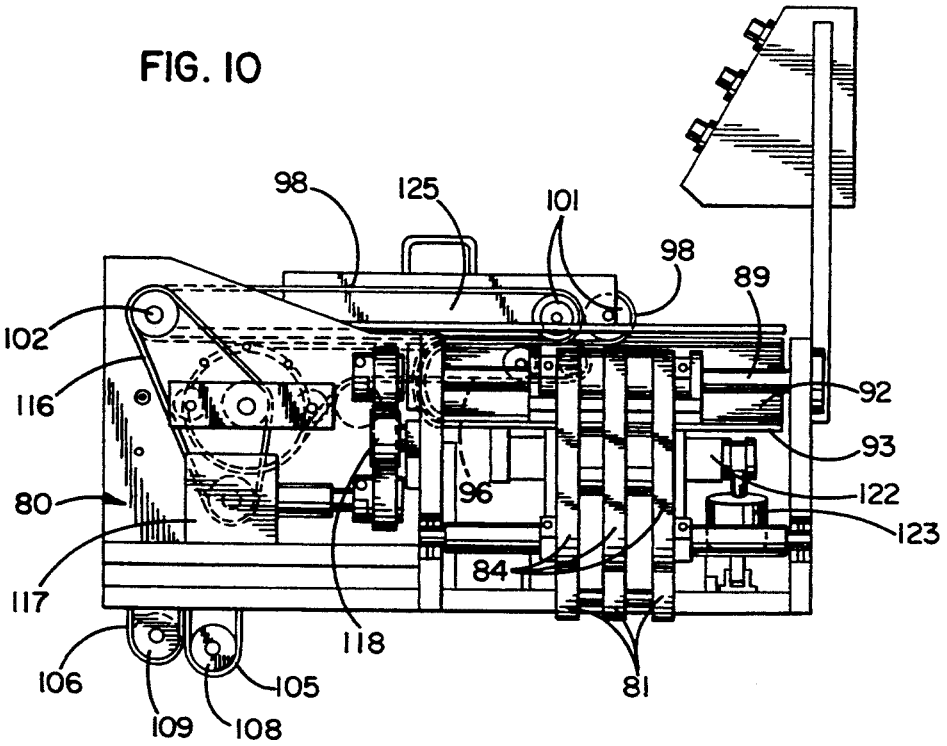

Another drive belt 116 (FIGS. 7, 9 and 10) also is rotated by the shaft 102 and acts through a right-angle gear box 117 to rotate a drive belt 118. That drive belt rotates a shaft 119 (FIG. 6) for driving the belts 81 and 90, the shaft 89 for driving the belts 88, and a shaft 120 for driving the belts 84.

Provision is made for enabling the clearing of paper jams in the turn section. For this purpose, the pulleys 91 for the lower nip belts 90 are mounted on a frame 122 (FIGS. 11 and 13) which are supported for vertical pivoting about the shaft 119. A reciprocating pneumatic actuator 123 is connected between the base 80 and the frame 122 and is operable to pivot the frame between an active position (FIGS. 8 and 11) in which the pulleys 91 are located in the notches 95 in the scoop 93 and a lowered position (FIG. 13) in which the pulleys and the exit end portions of the belts 90 are retracted downwardly away from the scoop.

In addition, the pulleys 99 and 101 for the belts 96 and 98 are mounted on a frame 125 which is mounted to pivot upwardly and downwardly about the shaft 102. A reciprocating pneumatic actuator 126 connected between the base 80 and the frame 125 is operable to pivot the latter between an active lowered position (FIG. 8) and an inactive raised position (FIGS. 12 and 13). When the frame is raised to its inactive position, the pulleys 101 are lifted out of the notches 97 in the scoop 93, and the entrance end portions of the belts 98 are raised away from the scoop. When the frame 125 is so positioned—and when the frame 122 is pivoted downwardly to its lowered position (FIG. 13)—the scoop 93 may be pulled away from the turning tube 92 and moved from its normal position of FIG. 11 to an opened position (FIG. 13) so as to greatly increase the width of the gap 94 and permit jammed paper to be cleared therefrom. Opening of the scoop is effected by manually pulling on a bar 130 attached to the outer side of the scoop. Vertical rods 131 extend from the bar 130 to horizontal mounting rods 132 which are slidably supported by the base 80 and which permit the scoop to be shifted between open and closed positions relative to the tube. The scoop is selectively and releasably held in its closed position by a permanent magnet 133 (FIG. 8) attached to one of the rods 131 and adapted to engage a fixed component of the base 80 when the scoop is closed.

An optical encoder is used to correlate operation of the apparatus 20 with operation of the host machine 24 and to keep the apparatus 20 in place with the host machine. The encoder detects the presence of the pockets 26 and the presence or absence of jackets 27 and starts and stops the servo motors 50, 57, 72 and 117 as necessary to maintain a phased relation between the positions of the stacks 28 and the positions of the pockets. In this particular instance, the belts 63 are advanced 18½ inches during each machine cycle and may be stopped for at least one cycle while still keeping the entire apparatus 20 in phase with the host machine. The apparatus thus may be inhibited and stopped if it is detected that one of the pockets 26 does not contain a jacket 27, thereby to avoid the feeding of inserts into an empty pocket. Also, the ability of the apparatus 20 to be stopped while staying in phase with the host machine enables the apparatus to be "household selective" in that inserts may be intentionally omitted from selected jackets.

While the present apparatus 20 has been shown as being capable of handling two bundles 31 and 32 of inserts 21 and 22, a single module or base may be constructed to collate three bundles of inserts. Also, a module identical to that which has been shown may be operably connected to the upstream end of the illustrated module in order to enable the handling of still additional bundles of inserts which are collated with the inserts 21 and 22 as the additional inserts proceed downstream.

The apparatus 20 is particularly useful in collating and feeding difficult-to-handle inserts which are made of lightweight and porous paper. Because relatively short and light queues are created, individual inserts may be reliably stripped from the queues and formed into shingles having a substantially uniform setback for purposes of keeping uniform spacing between the subsequently created stacks. The present apparatus totally avoids the problems associated with vacuum cup collating systems which tend to suck through the porous inserts and transfer multiple rather than individual inserts.

We claim:

1. Apparatus for collating first and second different documents into stacks and for feeding the stacks along a predetermined and generally horizontal path toward a using station, said first documents initially being contained in a first stacked bundle located above and spaced laterally from said path, said second documents initially being contained in a second stacked bundle also located above and spaced laterally from said path and spaced downstream along said path from said first bundle, said apparatus comprising:

(a) means including first and second stripping conveyors for stripping documents from said first and second bundles, respectively, for advancing the stripped documents laterally toward said path, and for forming the documents from said first and second bundles into first and second queues, respectively, located above said path;

(b) first and second vacuum belts for stripping documents from said first and second queues, respectively, and for advancing such documents upstream as first and second running shingles along first and second horizontal paths spaced above and extending generally parallel to said predetermined path;

(c) means associated with said vacuum belts for causing said first and second shingles to curve downwardly from said first and second paths, respectively, and to proceed downstream toward said predetermined path;

(d) means for stripping first documents from said first shingle after such shingle curves downwardly and for advancing said first documents downstream along said predetermined path in spaced relation with one another and toward said second shingle; and (e) means for stripping second documents from said second shingle after such shingle curves downwardly, for causing successive stripped second documents to be placed on top of successively spaced first documents advancing along said predetermined path so as to form spaced stacks of documents, and for advancing said stacks in spaced relation along said predetermined path toward said using station.

2. Apparatus as defined in claim 1 in which said means (c) comprise first and second sheaves associated with said first and second vacuum belts, respectively, each sheave causing its associated vacuum belt to travel around an arcuate turn, and nip rollers spaced around the periphery of each sheave and pressing the associated shingle against the vacuum belt as the latter travels around said turn.

3. Apparatus as defined in claim 2 in which said means (c) further include laterally spaced guide shoes located on opposite sides of each sheave and causing the associated shingle to exit said turn along a downwardly inclined path extending substantially tangent to said sheave.

4. Apparatus as defined in claim 3 in which said means (d) comprise upper and lower nip belts having an entrance throat located beneath said first sheave at the end of said downwardly inclined path, and means for driving said nip belts at a linear speed faster than the linear speed of said first vacuum belt whereby said nip belts grip and accelerate successive leading documents in said first shingle thereby to strip such documents from the first shingle and to cause such documents to advance in spaced relation along said predetermined path.

5. Apparatus as defined in claim 4 in which said upper nip belt includes a downstream end located adjacent said second sheave, said lower nip belt continuing downstream along said predetermined path beyond said downstream end of said upper nip belt, said means (e) comprising a second upper nip belt coacting with said lower nip belt to define an entrance throat located beneath said second sheave, said second upper nip belt being driven at a linear speed faster than the linear speed of said second vacuum belt and coacting with said lower nip belt to grip and accelerate successive leading documents in said second shingle thereby to strip such documents from the second shingle and to cause such documents to advance in spaced relation along said predetermined path.

6. Apparatus as defined in claim 1 further including:

(f) means for advancing said stacks upwardly from said predetermined path, for then advancing said stacks horizontally at right angles to said predetermined path, and for thereafter advancing said stacks vertically downwardly toward said using station.

7. Apparatus as defined in claim 6 further including:

(g) means for turning said stacks upside down after said stacks have been advanced upwardly from said predetermined path and before said stacks are advanced horizontally at right angles to said predetermined path.

8. Apparatus as defined in claim 7 in which said means (g) include a tube, a scoop disposed in spaced relation with said tube and coacting with said tube to define a gap for said stacks between said scoop and said tube, said gap having an entrance end and an exit end, first belt means for advancing said stacks into said gap from the entrance end thereof, and said means (f) including second belt means for advancing said stacks out of said gap from the exit end thereof.

9. Apparatus as defined in claim 8 in which said first belt means are normally located closely adjacent the lower side of said scoop and are pivotally supported to swing downwardly to an inactive position spaced downwardly from said scoop in order to facilitate the clearing of jammed stacks.

10. Apparatus as defined in claim 9 in which said second belt means are normally located closely adjacent the upper side of said scoop and are pivotally supported to swing upwardly to an inactive position spaced upwardly from said scoop in order to facilitate the clearing of jammed stacks.

11. Apparatus as defined in claim 10 in which said scoop is supported for selective movement away from said tube in order to enable the clearing of jammed stacks.

* * * * *